US005950649A

United States Patent [19]

Gerig

[11] Patent Number: 5,950,649

[45] Date of Patent: Sep. 14, 1999

[54] BRACEABLE, UNSUPPORTED ARCH ARRANGEMENT AND PROTECTIVE ROOF COMPRISING IT

[75] Inventor: Thomas Gerig, Wil, Switzerland

[73] Assignee: Gerig Grafik Design, Wil, Switzerland

[21] Appl. No.: 08/817,591

[22] PCT Filed: Aug. 7, 1996

[86] PCT No.: PCT/CH96/00277

§ 371 Date: Apr. 4, 1997

§ 102(e) Date: Apr. 4, 1997

[87] PCT Pub. No.: WO97/06326

PCT Pub. Date: Feb. 20, 1997

[30] Foreign Application Priority Data

Aug. 8, 1995 [CH] Switzerland ..... 2284/95

[51] Int. Cl.[6] ..... E04H 15/40; E04B 1/32

[52] U.S. Cl. ..... 135/125; 52/86; 135/906; 135/124; 135/126; 135/136; 135/138

[58] Field of Search ..... 135/122, 124, 135/128, 132, 133, 136, 138, 119, 906, 907, 908, 125, 126; 52/86

[56] References Cited

U.S. PATENT DOCUMENTS

| | | |
|---|---|---|
| 2,693,195 | 11/1954 | Frieder et al. . |
| 2,802,478 | 8/1957 | Fritsche . |
| 3,530,622 | 9/1970 | Cohen . |
| 3,534,750 | 10/1970 | Kolozsvary . |
| 3,751,862 | 8/1973 | Linecker . |
| 3,807,421 | 4/1974 | Geiger et al. . |
| 3,953,955 | 5/1976 | Huddle . |
| 4,078,572 | 3/1978 | Moss . |
| 4,325,207 | 4/1982 | Russel et al. . |
| 4,644,706 | 2/1987 | Stafford et al. . |
| 4,829,694 | 5/1989 | Oasheim . |
| 5,009,041 | 4/1991 | Fly . |
| 5,345,962 | 9/1994 | Moss . |
| 5,609,177 | 3/1997 | Iver . |

FOREIGN PATENT DOCUMENTS

| | | |
|---|---|---|
| 1116883 | 1/1982 | Canada . |
| 2189594 | 1/1974 | France . |
| 760960 | 11/1956 | United Kingdom . |
| 1364900 | 8/1974 | United Kingdom . |

*Primary Examiner*—Robert Canfield
*Attorney, Agent, or Firm*—Martin A. Farber

[57] ABSTRACT

An arch element (1") for protecting roofs has at least one tubular arch (2) held in the curved state by at least one brace (4). The ends of arch and brace (2, 4) are interconnected by end connectors (3). In order to keep the brace (2) out of the direct connection between both end connectors (3) and to guide it along the arch (2) at a certain distance thereof, a flat connecting part (5) is arranged between and joined to arch and brace (2, 4). By using three arches (2), two braces (4) designed as bracing booms, four fabric or plastic connecting surfaces (5) that join the braces (4) to the arches (2), and three spacers (10) that keep the outer arches (2) apart, an unsupported, dimensionally stable three-dimensional arch element (1") is obtained that may be used directly as a shade or associated to other arch elements to carry roof surfaces. By using arches (2), spacers (10) and end connectors (3) that can be plugged into each other, the arch element (1") may be dismounted.

35 Claims, 4 Drawing Sheets

BRACEABLE, UNSUPPORTED ARCH ARRANGEMENT AND PROTECTIVE ROOF COMPRISING IT

FIELD AND BACKGROUND OF THE INVENTION

The invention relates to an arch arrangement and to protective roofs.

Due to the reduction of the atmospheric ozone layer, the ultraviolet proportion of sun radiation increases which reaches the earth's surface. This results in an increased risk of skin damages that should be diminished by appropriate protective measures, particularly for children playing outside. Apart from wearing garments, the use of protective agents against the sun is recommended. These two measures are, however, not optimally efficient, particularly when bathing. Garments which cover a wide portion of the body are inappropriate due to the contact with water, while protective agents against the sun are washed off at least in part. In order to keep at least the direct sun rays off, sun-shades could be used.

However, sun-shades have the drawback that these mostly need a central, but optionally laterally arranged, support piece which has to be either put into the soil, or has to be held in a weight or cantilever member. A central arrangement of the support piece restricts the shady playing region considerably in an undesired manner. To put it into the soil is not possible, for example, with a stony underground, and carrying a weight or cantilever member would unnecessarily increase the load to be brought along to bathing.

Arrangements are known, for example, from the field of igloo tents wherein tube-shaped rods are braced curvilinearly by the tent-bottom or by tension chords that hold the rod ends. By using, for example, two arch portions extending transversely to each other interconnected via the tent-roof, a roof supporting arrangement is created which can be constructed without fastening or bracing to the soil, i.e. in an unsupported manner, when the stability requirements are small.

Such a tent-like protective roof, however, has the disadvantage that tension chords or a tent-bottom will affect in the shady area any undisturbed playing on a natural soil. A child would repeatedly fall over bracing chords, and in the case of use of a bottom layer, apart from obstruction by its rim, any contact with natural soil would be prevented which does not make sense especially on a sandy beach. Furthermore, a tent roof, with exception of the entrance area, will extend down to the bottom so that the shady playing space would be shut to the exterior, and free playing as well as perception of the surroundings would be very much restricted.

SUMMARY OF THE INVENTION

Now, the object of the invention consists in devising an unsupported shady arrangement leaving a central bottom area completely free and needing neither a fastening device to the soil nor a heavy and cumbersome weight or cantilever member. For the case of use in various leisure time activities, the arrangement should be detachable and lightweight.

In a first step according to the invention, it has been recognized that at least one braceable, unsupported arch element or an arch arrangement would be necessary for the shady arrangement whose two arch ends can stand on the soil, unsupportedly spanning over the area situated in-between. To this end, the arch element comprises at least one arch portion, particularly a rod to be bent, and a bracing portion, preferably a bracing chord interconnecting the two ends of the arch portion, as well as at least one sheet-like connecting portion or a connecting surface that connects the bracing portion to the arch portion at least in a partial area between the two ends of the arch portion.

By connecting the bracing and the arch portion the result will be obtained that the bracing portion does not extend along a direct connecting line between the ends of the arch portion, but extends in a curved manner at the same side as the arch portion. In a preferred embodiment, the arch portion and the bracing portion are parabolic, the curvature of the arch portion being, in particular greater than that of the bracing portion. Depending on the length of the arch portion and of the bracing portion as well as on the construction and the arrangement of the connecting surface, an arch element of a given curvature and span width will be obtained. The arch element is formed without any support at its two ends, thus being of stable shape of its own. For further bending the arch portion, considerable forces would be necessary which act from outside onto the arch's ends of the braced arch portion. Such forces, however, will not occur when the arch element is used as a support element with its ends directed to the bottom.

The connecting surface consists preferably of a web or of a flexible plastic layer and provides a seam-like receiving area for the arch portion, optionally interrupted in some sections, along its outer side facing the arch portion. The bracing portion, formed as a chord, is preferably fastened directly to the inner side of the connecting surface. In tensioned condition, the web of the connecting surface is tightly tensioned between the arch portion and the bracing portion. This sheet-like connection between arch portion and bracing portion will result in a high stability of shape of the arch element according to the invention. Therefore, it resists even elevated loads due to wind. For deforming the contour formed by the arch portion and the bracing portion, also the area spanned over by the connecting surface had to be changed to deform the arch element in its plane when tensioned, i.e. with tightened bracing chord. In doing this, diagonal forces would occur transversely within the connecting surface which, however, are absorbed by the connecting surface, thus preventing any deformation.

The deformation stability is highest when neither the bracing nor the arch portion is moveable relative to the connecting surface. Therefore the bracing portion is preferably formed as a tension chord unmoveably fixed, particularlying sewed to the connecting surface. The arch portion is preferably located in a seam-like holder of the connecting surface. In order to reduce, respectively disable, movements within said holder, there can be at least one fixation area or at least one bonding area with high friction inbetween the arch portion and the holder.

A reduction of the dislocatability inbetween the arch portion and the connecting surface is preferably achieved by a tight fit inbetween the holder and the arch portion and/or by a higher curvature of the arch portion relative to the curvature of the bracing portion and therefore by increasing the distance between the arch and the bracing portion from the endconnection towards the middle parts of the arch and bracing portions. The sheet-like connecting surfaces inbetween different parabolically formed bracing and arch portions fit according to there form only into the respective area inbetween the arch and the bracing portion.

The form stability of an arch arrangement standing on its ends is high in respect to admissible weight. This is due to the fact, that an equal weight on an parabolic arch arrangement standing on its ends causes longitudinal forces, respectively compression, against which the arch portion has a high stability. Weight forces in the central arch area causing a flatening of the curvature of the arch portion are absorbed due to the form stability partially as tensile forces by the bracing portion and by the connecting surface. Both the bracing portion and the connecting surface are very stable against tensile forces.

An above described arch element can be connected at both ends to a preferably rod-like support element, particularly arranged transversely to the plane of the arch element and prefenting as footings a sidewise canting of the arch element. A supporting structure for a roof can be arranged by combining at least two arch elements. The planes of the combined arch elements are for instance parallel or turned around a common axis and particularly connected to one another by holding means. Because the arch elements have the greatest hight in there central area, there can be provided supporting structures for shadow roofs without poles in the central area and enabling there a undisturbed playing.

The arch portions are preferably composed from tube pieces, whereby the solid parts of the decomposed supporting structure have a suitable size for transporting. Connecting surfaces consisting of a web or flexible plastic layer including tension chords fixed thereon are light and can be folded.

Undecomposeable embodiments are used for permanent roof constructions. The connecting surface, respectively the sheet-like connecting element, can then also be made of solid, particularly thin, material for example plywood or sheet metal. The arch portion and/or the bracing portion can according to the use also be a bent wood or metal part.

The described arch arrangement with a arch portion, a bracing portion and a connecting surface extends along a plane and is not very stable against forces transversal to said plane.

In a second step according to the invention, it has been recognized that for applications which need an increased stability of the arch arrangement in all directions, the connecting surface must not lie in a single plane. An embodiment of the arch arrangement must be provided with at least two arch portions, at least one bracing portion and at least two sheet-like connecting portions, whereby cross sections of the two sheet-like connections are aslant.

End connections are provided to connect the ends of the at least two arch portions to the ends of the at least one bracing portion. At least one spacer element is arranged aslant to the planes of the arch portions and connected to the arch portions, respectively to the connecting surfaces at the arch portions, to hold the arch portions in the central arch area at a given distance to each other. The arch arrangement is fully braced by the at least one bracing portion and by the at least one spacer element. The two sheet-like connecting portions form a surface which extends along at least a part of the arch portions and the at least one bracing portion and has a v-shaped cross section.

A roof surface with preferably parabolic longitudinal sections and cross sections with alternatively up and downward tilted partial surfaces is formed by several arch portions and bracing portions inbetween which are interconnected by sheet-like connecting portions connected to one another. The at least one spacer element presses the two outermost arch portions away from each other and is hold at the inner arch portions at least by guide means. A shady roof is preferably formed by an arrangement with three arch portions, two bracing portions each located inbetween the planes of two respective arch portions and with four sheet-like connecting portions.

Embodiments with bracing portions at the outermost sidewise positions are possible if the bracing portions and/or the connecting portions are made of solid material and therefore can take at least in one direction pressing forces, respectively shear forces aslant to this direction. The outermost bracing portions must be pressed away from each other by at least one spacer element, which extends aslant to the planes of the bracing portions. These embodiments include at least two, but preferably three, bracing portions and at least one, but preferably two, arch portions.

BRIEF DESCRIPTION OF THE DRAWINGS

With the above and other objects and advantages in view, the present invention will become more clearly understood in connection with the detailed description of preferred embodiments, when considered with the accompanying drawings of which

DETAILED DESCRIPTION OF THE PREFERRED EMBODIMENTS

Figure 1:
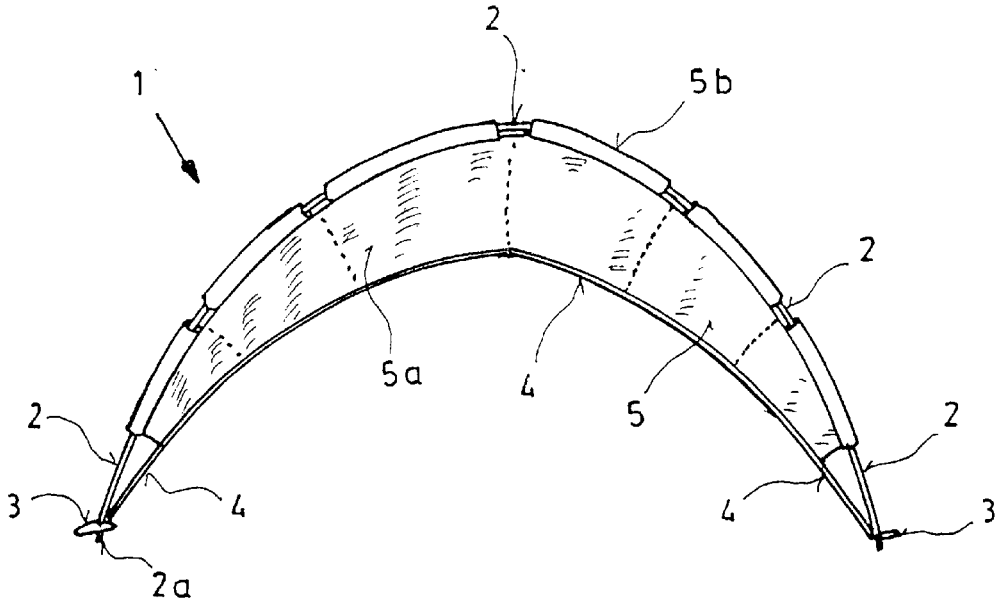
FIG. 1: View of an arch element with a planar connecting surface

FIG. 1 shows an essentially two dimensional, respectively planar, arch element 1 with a bar-shaped arch portion 2, which is on both ends connected to the ends of a bracing portion 4 by end connections 3. Inbetween the arch portion 2 and the bracing portion 4 there is a connecting surface 5 made of a web or a pliant plastic layer, which is at the side of the arch portion 2 as well as at the side of the bracing portion 4 essentially parabolically margined and preferably put together by interconnected parts 5*a*.

The arch portion 2 is inserted into a seam like guidance, respectively duct, 5*b* which is located on one side of the connecting surface 5. The bracing portion 4 is preferably a tension chord and particularly fixed by a seam to the connecting surface 5 at the side opposite to the arch portion 2. The tension chord 4 bends the arch portion 2 parabolically by tension forces acting on its ends. The bracing portion 4 is at least in the area of the connecting surface 5 parabolically shaped because of the connection between the arch portion and the bracing portion by the connecting surface, and therefore the straight line between the ends of the arch portion 2 stays free.

The arch portion 2 must be formed in a way that it can be bent sufficiently by the tension forces applyable by the tension chord 4 and the connecting surface 5. The restoring force of the arch portion 2 in the bent position must cause a taut tensioned arch element. The two dimensional form of the connecting surface 5, which extends preferably over the whole surface between the arch portion 2 and the bracing portion 4 close to the end connections, causes a hight form stability of the arch element. This form stability occurs without support at the ends and therefore it is an unsupported arch element.

The inventive arch elements ensure with little material, respectively weight, a very hight stability in the plane of the arch element and are therefore useful to support roofs. Interconnected arch elements are particularly useful to support shady surfaces in different ways. They do not need anchoring in the soil and can be formed in a way that their size is small in the disassembled state. The arch portion is preferably composed from partial pieces. It is clear that all from the field of tents known plug, buckling and snapp connections can be used between the partial pieces.

Erecting an arch element includes for example composing the arch portion from partial pieces, inserting it into the guidance 5*b* of the connecting surface, bending and finishing by connecting the end connection. Other possible embodiments have partial pieces which reside within the guidance 5*b* and are spanned, respectively folded, by buckling joints.

The end connections have to be formed in such a way that they can be connected and disconnected under tension. The arch portion 2 includes preferably on both ends a small endpart 2*a* with a smaller diameter. These two endparts 2*a* are plugable into holes at the tension chord ends. The increasing diameter from the endpart 2*a* to the bigger diameter of the arch portion 2 builds a stop on which the tension chord end stays. It is clear that any other end connection can be used.

Figure 2:
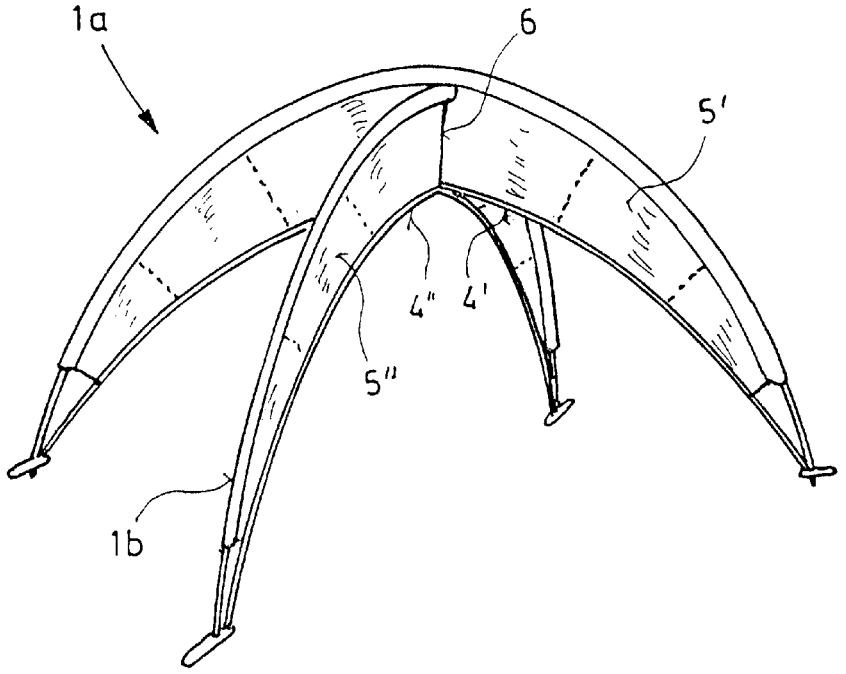
FIG. 2: Perspective view of two interconnected arch elements

FIG. 2 shows two interconnected arch elements 1*a* and 1*b*. In the shown embodiment the to elements 1*a* and 1*b* are connected by a seam 6, which connects the two connecting portions 5' and 5" of the two elements 1*a* and 1*b* along the symmetric axis of the elements 1*a*, 1*b*. The arch portions and the bracing portions 4', 4" of the arch elements 1*a*, 1*b* are located directly above each other in the area of the seam 6. A web or plastic surface fitting to the shape of the arch elements 1*a*, 1*b* is at least in the central area fixed in a tensioned state on the arch elements 1*a*, 1*b*, respectively having corners fixed to connecting elements thereof, and thereby giving shade and holding the orientation of the arch elements. Tension chords and/or rods can as well be used to interconnect the arch elements 1*a*, 1*b*.

The arch elements can also be parallel shifted beside each other and interconnected to support tunnel-like roof surfaces.

Figure 3:
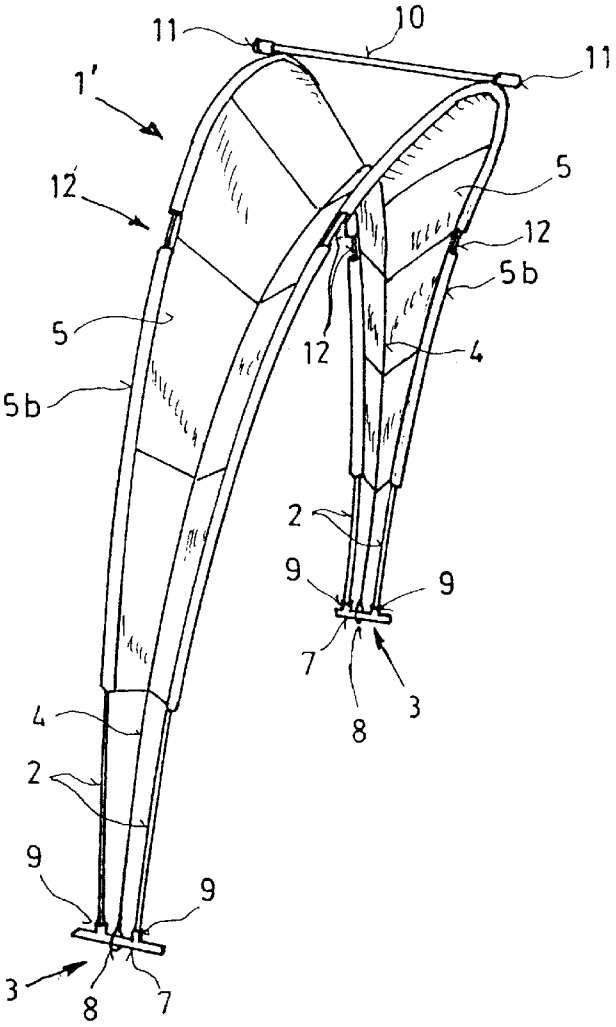
FIG. 3: Perspective view of an arch element with two arch portions, two connecting surfaces and one bracing portion

FIG. 3 shows a three dimensional arch element 1' with two essentially equally long rod-, respectively tube-shaped arch portions 2 and a bracing portion 4 inbetween. The bracing portion 4 is formed as a tension chord and connected to the arch portions 2 by two sheet-like connecting portions, respectively connecting surfaces 5. The two end connections 3 are connecting each two arch portion ends and a tension chord end.

A preferred end connection consists of a bar, respectively tube portion, to which central area the tension chord end is fixable, preferably by an end loop 8 around the tube portion 7. On both sides of the tension chord fixing there are connecting means, preferably plug in openings 9 for arch portion ends. The distance inbetween the openings 9 is preferably on both tube portions 7 equal and therefore the arch element 1' is relative to a central cross plane symmetric.

The arch portions 2 are longer than the tension chord, respectively build longer archs and therefore stand higher up. At least in the central upper area of the arch portions 2 there is a spacer element 10 to press the arch portions away from each other. In order to connect the spacer element 10 on both ends to respective arch portions 2, butt straps 11 particularly being pocket-shaped are preferably fixed at the guidances 5*b* into each of said butt straps 11 fits an end of the spacer element 10. Spacer elements or other connecting rods are possibly pressed directly inbetween arch portions 2 in guidance free areas 12, respectively fixed to these by holding elements.

The planes within which the arch portions 2 and the bracing portions 4 lie, are possibly parallel, particularly equally spaced. Preferably they are turnable into each other around a straight particularly essentially through two points laying slightly below the end connections. Therefore the arch arrangement is slice-shaped.

The distance between the arch portions increases according to the shown embodiment from the end connections 3 to the spacer element 10 in the central area. Because of this increasing distance and because of the shorter arch length of the bracing portion, also the width of the connecting surface 5 increases towards the spacer element 10 in the central area. When there is only one spacer element 10 in the central arch area, the arch portions 2 are pulled inbetween the spacer element 10 and the end connections 3 by the tension force of the tension chord, respectively by the forces within the connecting surfaces, towards the tension chord 4 and therefore also towards each other in such a way that the arch portions 2 are no more within planes. By introducing preferably at least three spacer elements 10 essentially equally spaced along the arch element 1' the arch portions 2 stay essentially within planes.

When the arch portions 2 and the tension chord 4 are ending at the end connections 3, respectively tube portions 7, along a line, then there is no torque in the end connections 3 and therefore the connecting means 9 for the arch portion ends do not have to stand torque. Because of the linear connection of the arch portions and the tension chord the radial distance between the arch portions 2 and the tension chord 4 becomes smaller towards the end connections 3. In order to hold radial forces within the connecting surface 5 also towards the end connection, this surface has to have also there a sufficient radial orientation. This is due to the small radial distance between the arch portions 2 and the bracing portion 4 only possible, if the distance between the arch portions 2 becomes smaller towards the end connections 3.

The slice-formed embodiment according to FIG. 3 enables a torquefree connection of the arch portions 2 and the bracing portion 4 without a substantial flatening of the v-shaped cross section of the connecting surfaces 5 towards the end connections 3. Additionally the slice-formed embodiment has the advantage that the arch element 1' has only a small extension in the area of the two end connections 3 and therefore the freedom of motion is only slightly reduced close to the bottom.

Embodiments which do not reduce the distance between the arch portions from a central area towards the end connections, have preferably end connections with starting points of the arch portions and the tension chord which are not on a straight line. The distance between the two ends of the tension chord is scaled smaller then the distance between the arch portion ends. Therefore the end connection needs also an extension towards the opposite end connection and have to transmit torque to the arch portion ends. This causes the need for a stronger construction.

Figure 4:
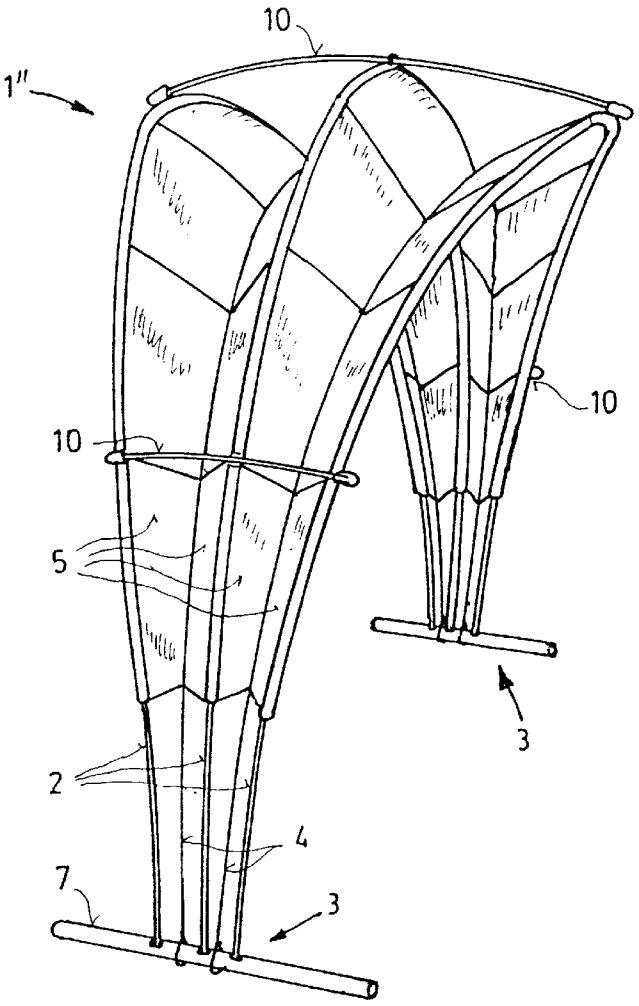
FIG. 4: Perspective view of an arch element with three arch portions, four connecting surfaces and two bracing portions

FIG. 4 shows an arch arrangement 1" with three arch portions 2 and two bracing portions each inbetween two arch portions 2. The two bracing portions 4 are each connected by connecting surfaces 5 with the arch portions 2 on either side of them. The two outermost arch portions 2 are pressed outwards by three spacer elements 10. This embodiment is advantageously usable as shady roof for example over a sandbox or at the beach. The connecting surfaces 5 are building the shady roof. Because the arch arrangement 1" is unsupportedly formstable, it can be used on ice or with floats at the end connections on water.

The arch portions 2 are preferably rods, composable of partial pieces, having a total length within a range of 4 to 6 m, possibly essentially of 5 m. The length of the two bracing portions 4 lies particularly within a range of 3.5 to 5.5 m, possibly essentially at 4.4 m. In order to make the sunroof dismountable in a small size, also the spacer elements 10 are composed rods. The biggest width of the connecting surfaces 5 lies in a range of 20 to 60 cm, particularly essentially at 40 cm.

It is clear that the shady effect can be increased by expanding the embodiment according to FIG. 4 sideways with a bracing portion, an arch portion and two connecting surfaces.

In order to increase the shady effect of the arch arrangement by connecting surfaces which are tilted downwards on the sides, it is possibly advantageous to arrange three bracing portions and inbetween each pair of bracing portions one arch portion, in total two arch portions. The two outermost bracing portions must be tensionable rods, preferably composed of snap-in partial pieces. The at least one spacer element of this embodiment is used for pressing outwardly the outermost bracing portions.

The end connections 3 formed as tube portions 7 are as long as is needed in order to prevent the sunroof from tilting under low windforces. In order to increase the stability there will be at least one fillable and preferably closeable bag fixed to an end connection or to at least one arch portion. The bag is filled when needed with material available at the place, preferably water.

Figure 5:
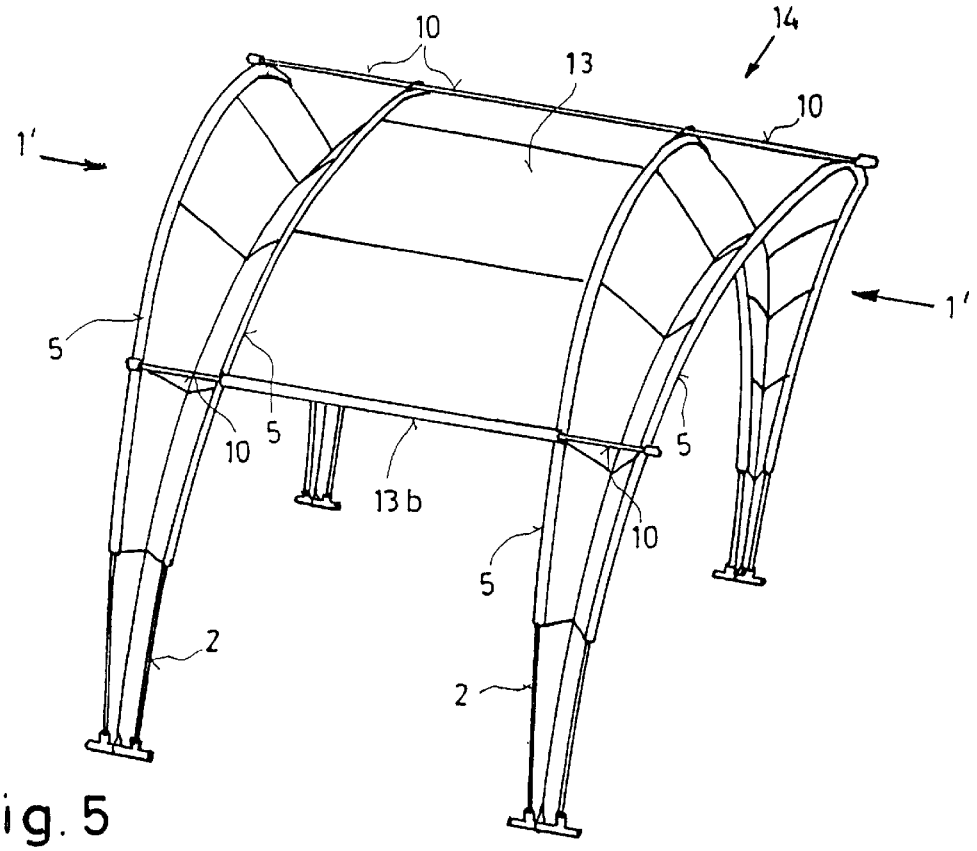
FIG. 5: Perspective view of a protective roof with two arch elements and a roof surface arranged between these elements

FIG. 5 shows a protective roof 14 including two arch elements 1' according to FIG. 3 as support elements for a tunnel-like protective roof. The spacer elements 10 of the first arch element 1' are connected to the respective spacer elements 10 of the second arch element 1'. The spacer elements 10 are common and extend from the outer side of one arch element 1' to the opposite outer side of the other arch element 1'. In the central arch area of the arch elements 1' there is a roof surface 13 interconnecting the the two arch elements 1'. Therefore said roof surface 13 is along arch portions 2 connected to connecting surfaces 5. The two free sides of the roof surface 13 are preferably provided with seam-like ducts 13*b* for spacer elements 10.

The connecting surfaces 5 of the two arch elements 1' and the roof surface 13 are formed as a single web- or plastic surface and make up the whole roof area of the protective roof 14. A big protective roof 14 is as well decomposeable in a small size and has a light weight. Therefore it is transportable and usable for different purposes. Because of the fact that the ground area stays free and there is no need for anchoring in the soil, it is an ideal protective roof for sandboxes and excavations.

The attractive appearance of the protective roof 14 enables an advantageous use for commercial purposes, particularly as a protective roof over an article to be sold, for example over a car, or as a roof of an information or sales stand. Thereby the roof surface 13 as well as the outer connecting surfaces 5 can be used for commercial information.

Figure 6:
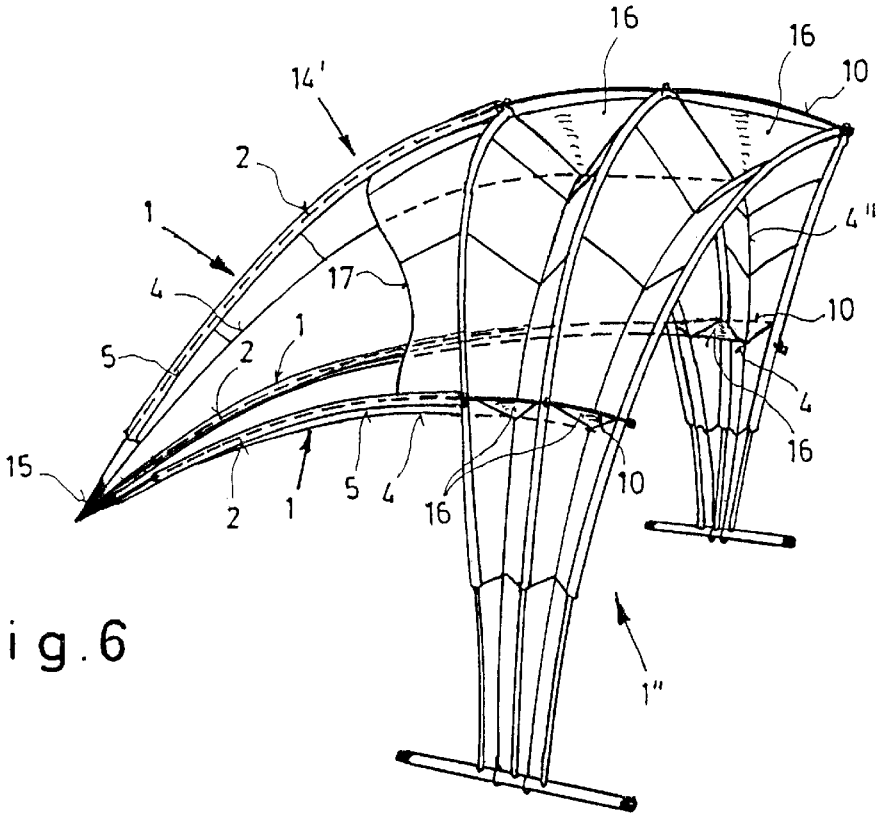
FIG. 6: Perspective view of a shell-formed protective roof including further arch elements in the extension of the spacer elements of a first arch element FIGS: 7*a* and 7*b*: Side views of an end connection with shackle.

FIG. 6 shows a shell-like embodiment of a protective roof 14' with four connected arch elements 1 and 1". In the extension of the three spacer elements 10 of the arch element 1" there are flat arch elements 1. The free ends of the three flat arch elements 1 end in a common foot portion 15. The arch portions 2 of the flat arch elements 1 are designed as elongated spacer elements 10. The bracing portions of the flat arch elements 1 are on one end connected to the foot portion 15 and on the other connected to a bracing portion 4" of the arch element 1". The connecting surfaces 5 of the flat arch elements 1 include triangular portions 16 at the arch element 1". A roof portion 17 extends from the arch element 1" over the flat arch elements 1 towards the foot portion 15.

Figure 7A:
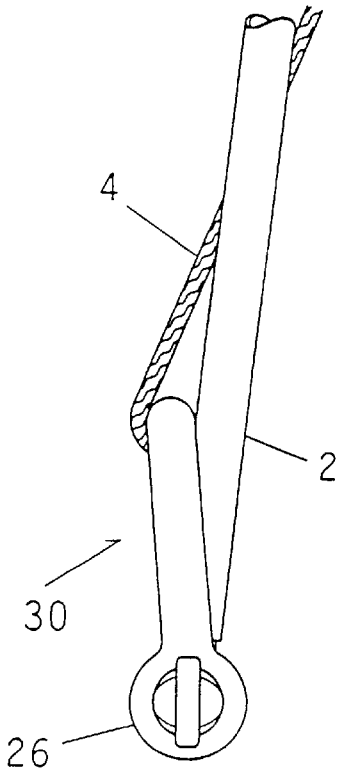
FIG. 7*c* section view of a tube with an eye hook and elastic band.
Figure 7B:
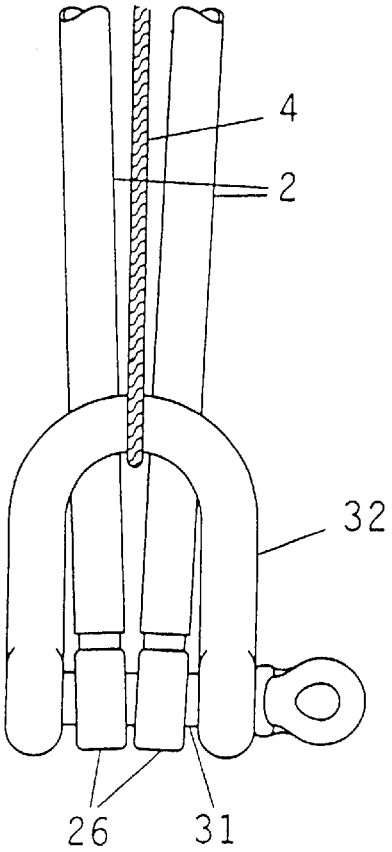

FIGS. 7*a* and 7*b* show an other advantageous embodiment of the end connection in the form of a shackle 30. At the ends of the arch portions 2 there are eye hooks 26 through which the locking bolt 31 of shackle 30 is extending. The bracing portion 4 is fixed to the u-portion 32 of the shackle 30. The bracing portion end can be put through shackle 30, tensioned and fixed, respectively hung up or crammed. It is clear, that according to the purpose of the arch element, different shackle can be used. In order to fix the shackle to the soil, a portion can be arranged on the bolt 31, through which portion a fastening element—like a stake—can be placed.

Figure 7C:
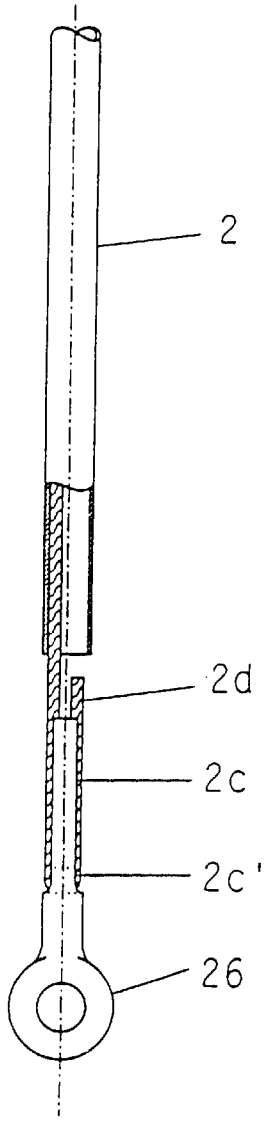

FIG. 7*c* shows an end of a arch portion 2 composed of tube portions, which are pulled together by an elastic band 2*d* arranged within the tube portions. The eye hook 26 is fixed with a bolt part 2*c* within a tube portion. The bolt part 2*c* also fixes the elastic band 2*d*, which is placed through a hole 2*c*' within the bolt part 2*c* before pushing said bolt part into the tube portion. In the mounted state the elastic band 2*d* is squeezed inbetween the bolt part 2*c* and the inner wall of the tube portion.

It is clear that all features of the described embodiments can be freely combined and that specific protective roofs can be manufactured by different combinations of arch elements and supported roof surfaces.

The inventive arch elements are not restricted to building and supporting protective roofs but can be used in general as arch shaped construction elements. Besides the use in construction works there are also remarkable uses in the field of tents, play objects and play scapes. The material is selected according to the requirements. At permanent installations there is no need for decomposability.

I claim:

1. A braceable, unsupported arch arrangement comprising:

at least one elongated, bendable arch portion providing a restoring force when bent;

at least one longitudinal bracing portion for bending and bracing at least one bendable arch portion;

at least one sheet-like connecting portion for holding said at least one bracing portion and said at least one arch portion curved to the same side, said bracing portion and said arch portion being in adjacent relationship at opposite sides of said connection portion, wherein said arch portion has a greater overall curvature than said bracing portion; and at least one pair of end connections for interconnecting said arch portion and said bracing portion in braced condition at respective end regions thereof;

wherein said arch arrangement is to be set up by bracing said at least one arch portion by said at least one bracing portion; and said arch arrangement being tensioned by the restoring force of said at least one arch portion, and being form-stabilized by said connecting portion, thereby being stable in unsupported conditions.

2. Arch arrangement as claimed in claim 1, characterized in that in braced condition, at least one arch portion (2) and at least one longitudinal bracing portion (4) are bent to the same side, preferably parabolically, the arch portion (2), in particular, being curved more than said bracing portion (4) so that the distance between said arch portion (2) and said bracing portion (4) increases from said end connections (3) towards the middle of said arch portion and said bracing portion.

3. Arch arrangement as claimed in claim 1, comprising two of said arch portions, one of said bracing portion and at least one spacer element, wherein said bracing portion is disposed between planes of said arch portions and connected to each of said arch portions via said at least one connection portion and wherein said arch portions are laterally spaced by said at least one spacer element.

4. Arch arrangement as claimed in claim 3, wherein planes in which said arch portions and said bracing portion extend are rotatable in one another about a straight line, which extends substantially through two points situated somewhat at or below said end connections, so that the arch arrangement has a slice-like appearance.

5. Arch arrangement as claimed in claim 3, wherein said at least one spacer element is formed by a composite rod.

6. Arch arrangement as claimed in claim 3, wherein at least two of said connection portions comprise each at least one respective butt strap at the laterally outer arch portions for receiving at least one of said spacer elements, said butt straps being pocket-shaped so that said spacer elements meet outer abutments at their two ends for holding them in a desired distance.

7. Arch arrangement as claimed in claim 1, comprising three of said arch portions, two of said bracing portions and at least one spacer element, wherein said bracing portions are disposed between planes of successive pairs of said arch portions and connected to said arch portions of said respective pair via said connection portions and wherein the arch portions are laterally spaced by said at least one spacer element.

8. Arch arrangement as claimed in claim 1, wherein said at least one arch portion is formed by a rod.

9. Arch arrangement as claimed in claim 8, wherein said rod comprises partial pieces.

10. Arch arrangement as claimed in claim 1, wherein said at least one bracing portion is formed by a tension chord.

11. Arch arrangement as claimed in claim 1, wherein the length of said at least one arch portion is within a range of 4 to 6 m, and the length of said at least one bracing portion is within a range of 3.5 to 5.5 m.

12. Arch arrangement as claimed in claim 1, wherein said at least one bracing portion is formed by a tensile stressable rod.

13. Arch arrangement as claimed in claim 12, wherein said tensile stressable rod comprises partial pieces.

14. Arch arrangement as claimed in claim 1, wherein said at least one connection portion is formed by a web.

15. Arch arrangement as claimed in claim 1, wherein said at least one connection portion has at least on one side a fastening arrangement for receiving said arch portion.

16. Arch arrangement as claimed in claim 15, wherein said fastening arrangement of the connecting portion comprises a seam-like holder.

17. Arch arrangement as claimed in claim 1, wherein said at least one connection portion is on one side fastened directly to a chord being said at least one bracing portion.

18. Arch arrangement as claimed in claim 1, wherein said at least one connection portion comprises parabolic edges, and becomes narrower towards two end regions.

19. Arch arrangement as claimed in claim 18, wherein said at least one connection portion has in a central region a width of substantially 40 cm.

20. Arch arrangement as claimed in claim 19, wherein said central region of the connecting portion extends over a large portion of the length of said arch portion and is omitted adjacent regions near said end connections so as to avoid difficulties in setting up the arch arrangement.

21. Arch arrangement as claimed in claim 18, wherein said at least one connection portion is composed of interconnected parts, connection lines of the parts extending from the side of said at least one arch portion to the side of said at least one bracing portion.

22. Arch arrangement as claimed in claim 21, wherein said interconnected parts are sewed together.

23. Arch arrangement as claimed in claim 18, wherein at least two of said connection portions are interconnected along respective longitudinal edges thereof so that at least two of said arch portions and at least one of said bracing portions are held together.

24. Arch arrangement as claimed in claim 1, wherein said end connections comprise each a rod-like support element arranged transversely to the arch's central longitudinal plane.

25. Arch arrangement as claimed in claim 1, wherein said end connections comprise a weight element.

26. Arch arrangement as claimed in claim 25, wherein said weight element is a water fillable bag.

27. Arch arrangement as claimed in claim 1, wherein the length of said at least one arch portion is about 5 m and the length of said at least one bracing portion is about 4.4 m.

28. Arch arrangement as claimed in claim 1, wherein said at least one connection portion is formed by a flexible plastic layer of tearproof material.

29. Arch arrangement as claimed in claim 1, wherein:

said connecting portion holds said bracing portion along a curved line such that the bracing portion is curved compared to a direct connecting line between two ends of said arch portion;

said bracing portion interconnecting said two ends of said arch portion and said connecting portion connecting said bracing portion to said arch portion act to bend and brace said arch portion; and said sheer-like connecting portion is tightly tensioned between the arch portion and the bracing portion by said restoring force of said arch portion, whereby a stable curvature shape is formed without any support at two end regions of the arch arrangement.

30. Arch arrangement as claimed in claim 1, wherein the ends of the arch portion and of the bracing portion terminate distributed over a substantially linear joining area, which is in form of a shackle.

31. A protective roof comprising a roof surface and at least one arch arrangement supporting said roof surface, wherein said at least one arch arrangement comprises:

at least one elongated, bendable arch portion providing a restoring force when bent;

at least one longitudinal bracing portion for bending and bracing said at least one arch portion;

at least one sheet-like connecting portion for holding said at least one bracing portion and said at least one arch portion curved to the same side, said bracing portion and said arch portion being in adjacent relationship at opposite sides of said connection portion, wherein said arch portion has a greater overall curvature than said bracing portion; and at least one pair of end connections for interconnecting said arch portion and said bracing portion in braced condition at respective end regions thereof;

wherein said arch arrangement is set up by bracing said at least one arch portion by said at least one bracing portion; and said arch arrangement being tensioned by said restoring force of at least one of said arch portions, and being form-stabilized by said connecting portion, thereby being stable in unsupported conditions.

32. Protective roof as claimed in claim 31, further comprising at least one of said arch arrangements wherein said arch arrangement comprises two of said arch portions and one of said bracing portions being disposed between the planes of said arch portions and connected to each of them via one of said connection portions, said roof surface has a triangular form with a free edge and is connected with a side opposite to said free edge to an arch portions of said arch arrangement to form a mussel-shaped protective roof, wherein at least one substantially stable girder is used to keep said roof surface substantially tight and said arch portions laterally spaced.

33. Protective roof as claimed in claim 32, further comprising three of said girders extending from a joining point at said free edge of the roof surface to points at said arch portion opposite to said free edge pushing said arch portion away from said free edge.

34. Protective roof as claimed in claim 31, further comprising at least two of said arch arrangements wherein said arch arrangements comprise two of said arch portions and one of said bracing portions being disposed between the planes of said arch portions and connected to each of them via one of said connection portions, said arch arrangements are arranged substantially parallel at a distance to each other and said roof surface is connected to adjacent arch portions of both arch arrangements to form a tunnel-shaped protective roof, wherein at least one substantially stable girder is used to keep said roof surface substantially tight and said arch portions laterally spaced.

35. Protective roof as claimed in claim 34, further comprising three of said girders pushing outermost arch portions of said arch arrangements apart.

* * * * *